US007892157B2

(12) United States Patent
Arnett

(10) Patent No.: US 7,892,157 B2
(45) Date of Patent: Feb. 22, 2011

(54) EXERCISE APPARATUS AND METHOD

(76) Inventor: Darren L. Arnett, 4263 Kirkham St., San Francisco, CA (US) 94122

( * ) Notice: Subject to any disclaimer, the term of this patent is extended or adjusted under 35 U.S.C. 154(b) by 0 days.

(21) Appl. No.: 11/542,653

(22) Filed: Oct. 2, 2006

(65) Prior Publication Data

US 2008/0081750 A1 Apr. 3, 2008

(51) Int. Cl.
*A63B 21/00* (2006.01)
*A63B 71/00* (2006.01)

(52) U.S. Cl. ..... 482/131; 482/139; 482/907

(58) Field of Classification Search ..... 482/121–126, 482/91, 907, 44–49
See application file for complete search history.

(56) References Cited

U.S. PATENT DOCUMENTS

| | | | | |
|---|---|---|---|---|
| 5,090,691 | A * | 2/1992 | Pollock | 482/139 |
| 5,209,712 | A | 5/1993 | Ferri | |
| 5,518,486 | A * | 5/1996 | Sheeler | 482/131 |
| 5,556,369 | A * | 9/1996 | Roberts | 482/131 |
| 5,944,640 | A | 8/1999 | Larsson | |
| 6,036,626 | A * | 3/2000 | Taylor | 482/121 |
| 6,503,175 | B1 | 1/2003 | Harrell | |
| 6,921,354 | B1 * | 7/2005 | Shifferaw | 482/91 |
| 7,137,935 | B2 * | 11/2006 | Clarke et al. | 482/123 |
| 2003/0125170 | A1 * | 7/2003 | Vernon | 482/124 |
| 2005/0043154 | A1 * | 2/2005 | Atrizadeh | 482/124 |
| 2005/0227833 | A1 * | 10/2005 | Wilkinson | 482/124 |
| 2005/0282689 | A1 * | 12/2005 | Weinstein | 482/124 |
| 2006/0264302 | A1 * | 11/2006 | Sjodin | 482/91 |

OTHER PUBLICATIONS

Blast Straps Special Report <http://web.archive.org/web/20050530061307/http://www.elitefts.com/documents/blaststrapreport.pdf> May 30, 2005.*

Elite Fitness Systems Special Report "Blast Straps Special Report" (2005).

Sports Finess Advisor "PNF Stretching" Sports Finess Advisor.com (2001).

* cited by examiner

*Primary Examiner*—Fenn C Mathew
(74) *Attorney, Agent, or Firm*—Perkins Coie LLP

(57) ABSTRACT

A technique for exercise and strength training is disclosed. The technique involves a device that can be affixed to a support point which can allow the user to exercise using body weight. In one embodiment, the stability of the device can be adjusted by varying the position of a stability member.

10 Claims, 8 Drawing Sheets

501 - 1

501 - 2

502 - 1

502 - 2

503

504 - 1

504 - 2

505 - 1

505 - 2

506 - 1

506 - 2

507 - 1

507 - 2

EXERCISE APPARATUS AND METHOD

BACKGROUND

Strength training is used to develop the strength, size, and/or endurance of skeletal muscles. Properly performed, strength training can provide significant functional benefits and improvement in overall health and well-being. Strength training is often associated with resistance training, and particularly weight training. Normally, strength training requires a wide variety of exercise machines and/or weights. The machines or weights can be purchased or a monthly fee must be paid to have access to a gym. Additionally, certain strength exercises require the use of heavy and cumbersome weights which may cause injury if improperly used.

Exercise machines and weights have several disadvantages when used to strengthen skeletal muscle. Exercise machines are usually safer but often do not effectively train stabilizer muscles. In general, free weights more effectively train stabilizer muscles but are more dangerous. In addition, both exercise machines and weights cannot effectively vary the emphasis on the stabilizer muscles.

Certain devices have been developed which allow the user to use body weight for stretching or strength training. These devices have a disadvantage because the emphasis on the stabilizer muscles cannot be varied during exercise. Further, these devices cannot effectively train specific muscles required for mountain and/or rock climbing.

Proprioceptive Neuromuscular Facilitation (PNF) involves stretching a muscle group passively, contracting the muscle group isometrically while in the relaxed position, relaxing the muscle group and then increasing stretch passively. PNF stretching is typically more effective and more comfortable than conventional stretching, because it exploits the body's own neural mechanisms. PNF has a disadvantage because it usually requires the assistance of a partner.

The foregoing examples of the related art and limitations related therewith are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools, and methods that are meant to be exemplary and illustrative, not limiting in scope. In various embodiments, one or more of the above-described problems have been reduced or eliminated, while other embodiments are directed to other improvements.

A technique for strengthening stability muscles can involve an exercise apparatus and method. In some cases, the apparatus allows the user to vary stability by adjusting a stability member. In other cases, the user can use body weight as a resistance force while exercising. In some additional cases, the apparatus allows the user to engage in strength training suitable for rock-climbing. Also, exercises are demonstrated using the apparatus in a manner to increase strength and/or endurance. In some embodiments, these exercises allow the stability to be varied to target stabilizer muscles. In other embodiments, PNF stretching can be performed without assistance.

The proposed system, method and device can offer, among other advantages, improved strength and/or endurance training. This can be accomplished in an efficient and robust manner compared to other strength training alternatives.

Advantageously, the proposed system, method and device can be used to effectively train skeletal muscle including stabilizer muscles. The system can also provide effective exercises suitable for training in rock-climbing.

BRIEF DESCRIPTION OF THE DRAWINGS

Embodiments of the inventions are illustrated in the figures. However, the embodiments and figures are illustrative rather than limiting; they provide examples of the invention.

DETAILED DESCRIPTION OF THE DRAWINGS

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments, of the invention.

Figure 1:
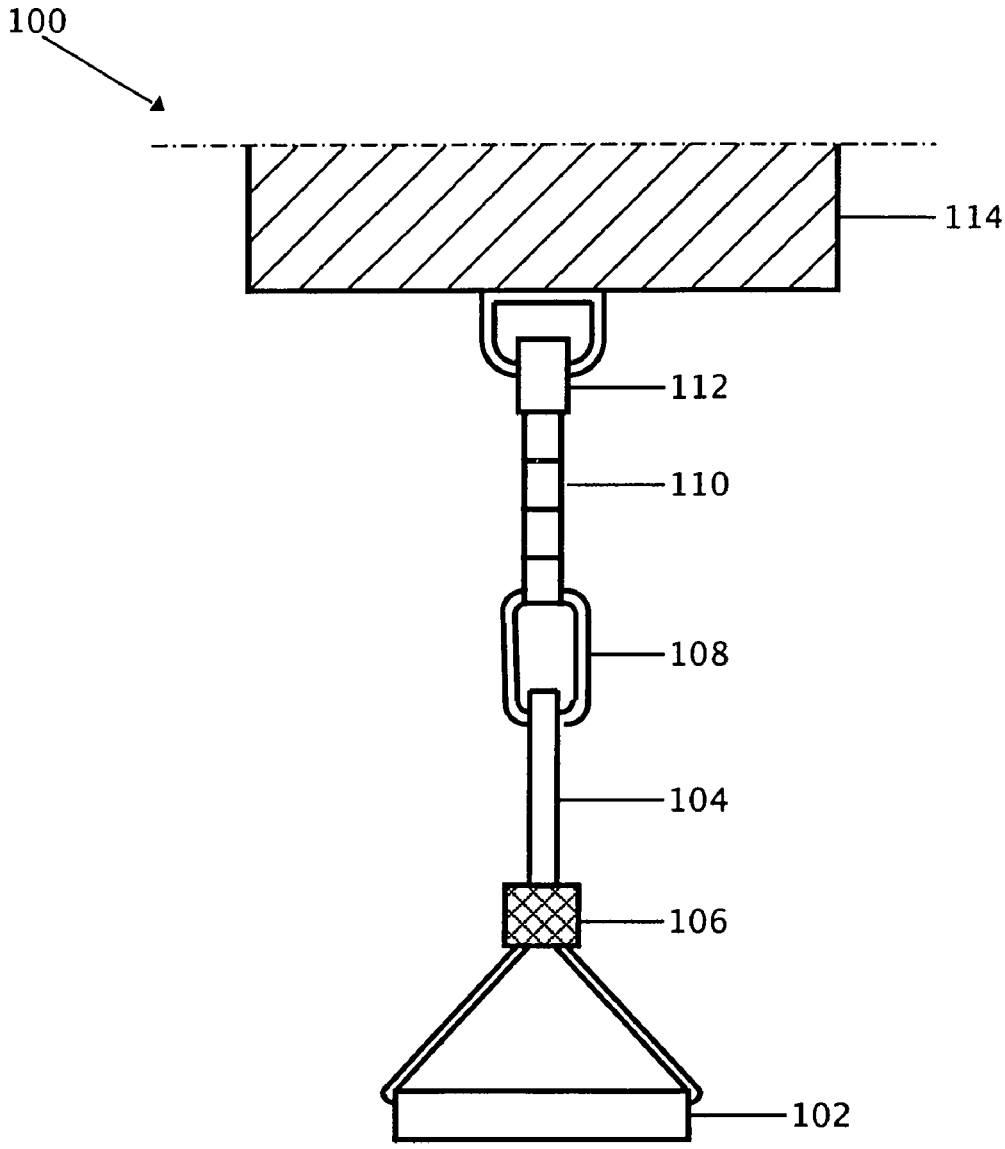
FIG. 1 depicts an example embodiment of an exercise device including an adjustable stability point.

FIG. 1 depicts an example of an exercise device 100 with an adjustable stabilizing member. The example exercise device 100 includes a handle 102, an elongated control strap 104, a control buckle 106, a connector 108, an elongated anchor strap 110, an adjuster 112, and a support point 114.

The handle 102 is a hollow, rigid structure with the strap 104 going through the length of the handle 102 and exiting at opposite ends. The handle 102 is cylindrical in shape but in other embodiments any shape may be used which are known and/or convenient. The handle 102 is wider than the average user's hand, making it easy to grip without abrasion from the strap 104. In example embodiments, different handle lengths can be used to affect the stability of the apparatus. The width of the handle 102 may be varied depending on the size of the potential user of the device. For example, a small, medium, large set could be created or a set targeted at women or men.

In some example embodiments, a handle may be metal, plastic, composite material, or any material or combination of material known and/or convenient. In some example embodiments a handle will be padded. Examples of padding materials include cloth, EPDM foam material, sponge material, or any other material known and/or convenient. In some example embodiments a handle will be curved. In some example embodiments, a handle will be telescoping thereby allowing the width to be varied and varying the stability of the apparatus.

In some example embodiments the handle will include an attached strap, which may be padded, to be used as a contact point for exercise. The padded strap may be used as a contact point against the body in circumstances where using a rigid handle would be uncomfortable or unwieldy. In some example embodiments, the padded strap may be used in conjunction with the handle as a foot harness, where the bottom of the foot is placed on the handle and the ankle contacts the padded strap. In this manner the exercise device may be used for a greater number of possible exercise positions.

In an addition example embodiment, straps are attached to either end of a handle. In these embodiments the handle may or may not be hollow. The handle may be attached to the strap by rivets, loops, clamps, or any other method known and/or convenient. In this example embodiment the straps may be part of one continuous piece or multiple non-continuous pieces.

In the example of FIG. 1, the control strap 104 goes through the handle 102, both ends of the control strap 104 converge at a control buckle 106, and the control strap 104 is attached to a connector 108. The control strap 104 is flexible and strong enough to support a user's bodyweight. The strap is elongated and usually at least 4 feet in length but a longer or shorter length may be used depending on use and/or cost.

In some example embodiments, a control strap may be military grade tubular webbing, a nylon strap, a rubber strap, a metal cord, a plastic wire, or any other strap known and/or convenient. In some example embodiments, a control strap may contain a spring section creating a greater level of instability during exercise. The spring section may be releasably inserted or built into the strap itself. In some example embodiments, a control strap is marked at specific locations, each mark indicating a point to set a control member to vary the level of stability to a specific and repeatable exercise. The marks may either be permanent or they maybe adjustable by the user. In some example embodiments, the strap is marked with indentations, notches, depressions to make it easier to set the correct location of a control buckle.

The control strap 104 goes through and is traversed by the control buckle 106. The control buckle 106 holds the strap in place and creates a point of convergence in the strap 104 at the control buckle 106. The control buckle 106 is adjustable by the user so the point of convergence may be adjusted to be farther or closer to the handle 102. The control buckle 106 is designed to securely hold the point of convergence in place on the control strap 104.

In some additional example embodiments, a ring, a collar, a clamp, or any other known and/or convenient securing mechanism may be used as the control buckle 106. In some example embodiments, a control member may be made of plastic, rubber, metal, composite, or another material known and/or convenient.

The connector 108 is attached to the control strap 104 and the anchor strap 110. The connector 108 may be any suitable material which will support the weight of the user's body. The connector may be attached to the control strap 104 and the anchor strap 110 in any manner known and/or convenient. For example, and not limitation, the control strap and the anchor strap may be looped around the connector 108 to facilitate the connection. In additional examples, the connector 108 may include a clamp portion to clamp the receiving ends of the control strap and anchor strap in place. In other embodiments, the control strap 104 and anchor strap 110 may be removably and/or irremovably tied to the connector 108. In further embodiments, any convenient and/or known technique may be used to attach the connector to the straps.

In some example embodiments, a fastener may be made of metal, plastic, rubber, composite, or another material known and/or convenient. In some example embodiments, a fastener may be a carabineer, a ring, a latch, or any other fastener known and/or convenient. In some example embodiments a fastener may be releasably attached to a control member and an anchor member.

The anchor strap 110 is attached to the connector 108 and runs through the adjuster 112. The anchor strap 110 is flexible and strong enough to support a user's bodyweight. The anchor strap is elongated and is usually of at least 3 feet in length although different lengths can be used based on desired use and/or cost.

In some example embodiments, the anchor member may be marked to indicate the position to be used in relation to an adjustable fastener. The different lengths can correspond to the length needed for different exercises, the intensity of a particular exercise, the portion of the muscle to emphasize, or for any other known and/or convenient reason. In some example embodiments an anchor strap may be military grade tubular webbing, a nylon strap, a rubber strap, a metal cord, a plastic wire, or another item know or convenient. In some example embodiments, an anchor member is releasably attached to a connector and/or an adjuster.

The adjuster 112 traverses the anchor strap 110 and allows the length of the strap to be adjusted. The adjuster 112 is attached to the support point 114 either directly or through intermediaries. The adjuster can be a clamp which uses friction to substantially hold the anchor strap 110 at the desired length while in use. In some example embodiments, an adjuster can be a cam lock buckle or any other known and/or convenient alternative.

The support point 114 is a stable structure which can bear the weight of a user while exercising. The adjuster 112 is attached to the support point 114 either directly or through intermediaries. The support point 114 supports the user while an exercise is in progress. In some example embodiments a support point includes: a ceiling, a wall, support beams, a support cage, chin-up bar, or any other known and/or convenient alternative. In some example embodiments, a plate with multiple adjustable attachment points is mounted to a stable structure. The plate allows the apparatus to be attached at multiple and adjustable locations to increase the diversity of exercises possible.

Figure 2:
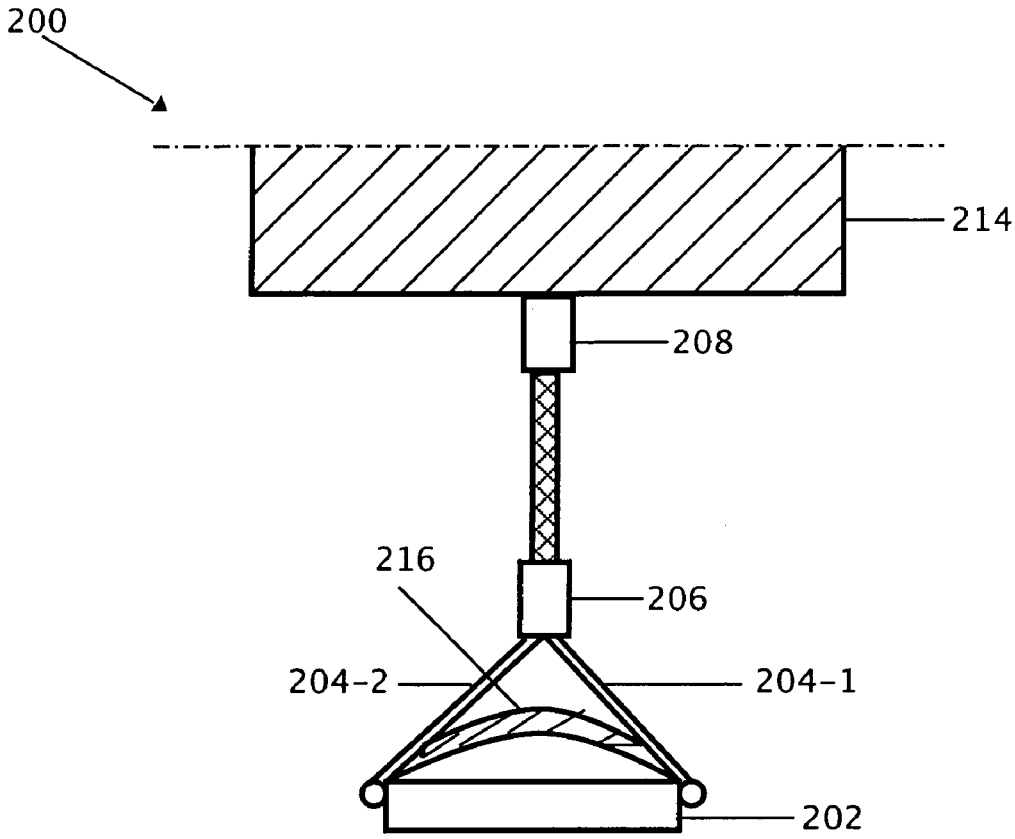
FIG. 2 depicts an example embodiment of an exercise device including an adjustable stability point.

FIG. 2 depicts an example of an exercise device 200 with an adjustable stabilizing point. The exercise device 200 includes a handle 202, elongated flexible control straps 204-1 and 204-2, a stability member 206, a fastener 208, a support structure 214, and an optional foot strap 216.

The handle 202 is a rigid structure with the control straps 204-1 and 204-2 attached at the ends of the handle 202. In the example of FIG. 2, the optional foot strap 216 is also attached at the ends of the handle 202. In some example embodiments, the handle and/or foot strap may be metal, plastic, composite material, or any material or combination of materials known and/or convenient. In some example embodiments the handle and/or foot strap will be padded. In some example embodiments, the handle is hollow. In other example embodiments, the handle will be curved. In some example embodiments, the foot strap can be suited to loop around a section of the user's foot and/or leg and can be used as a contact point rather than or in conjunction with the user's hand. In some example embodiments, the attached strap is suited as a contact point another section of the user's body such as abdomen, neck, or arm.

The control straps 204-1 and 204-2 attach at the ends of the handle 202 and converge at the stability member 206. The stability member 206 may be adjusted to make the control straps convergence point closer to the handle 202 or farther away from the handle 202, depending on the desired stability level. The control straps 204-1 and 204-2 go through the stability member 206 and attach to the fastener 208. In some example embodiments, control members 204-1 and 204-2 may be military grade tubular webbing, a nylon strap, a rubber strap, a metal cord, a plastic wire, or any other item know or convenient. In some example embodiments, control members are releasably attached to a handle and/or a fastener. In some example embodiments, control members are attached to a handle and/or a fastener in a manner allowing rotation of the handle.

The fastener 208 is attached to the control members 204-1 and 204-2 and the support structure 214. The fastener 208 serves as the connection point between the control straps 204-1 and 204-2 and the support point 214, and transfers the weight applied to the control straps to the support point 214.

In some example embodiments, a fastener may be made of metal, plastic, rubber, composite, or any other material known and/or convenient. In some example embodiments, a fastener is attached to a support structure 214 by a loop, bolts, clamps, nails, or another method known and/or convenient. In some example embodiments, a fastener is connected to a mounting plate which may be mounted on a support structure. The mounting plated may be mounted by any method known of convenient.

Figure 3:
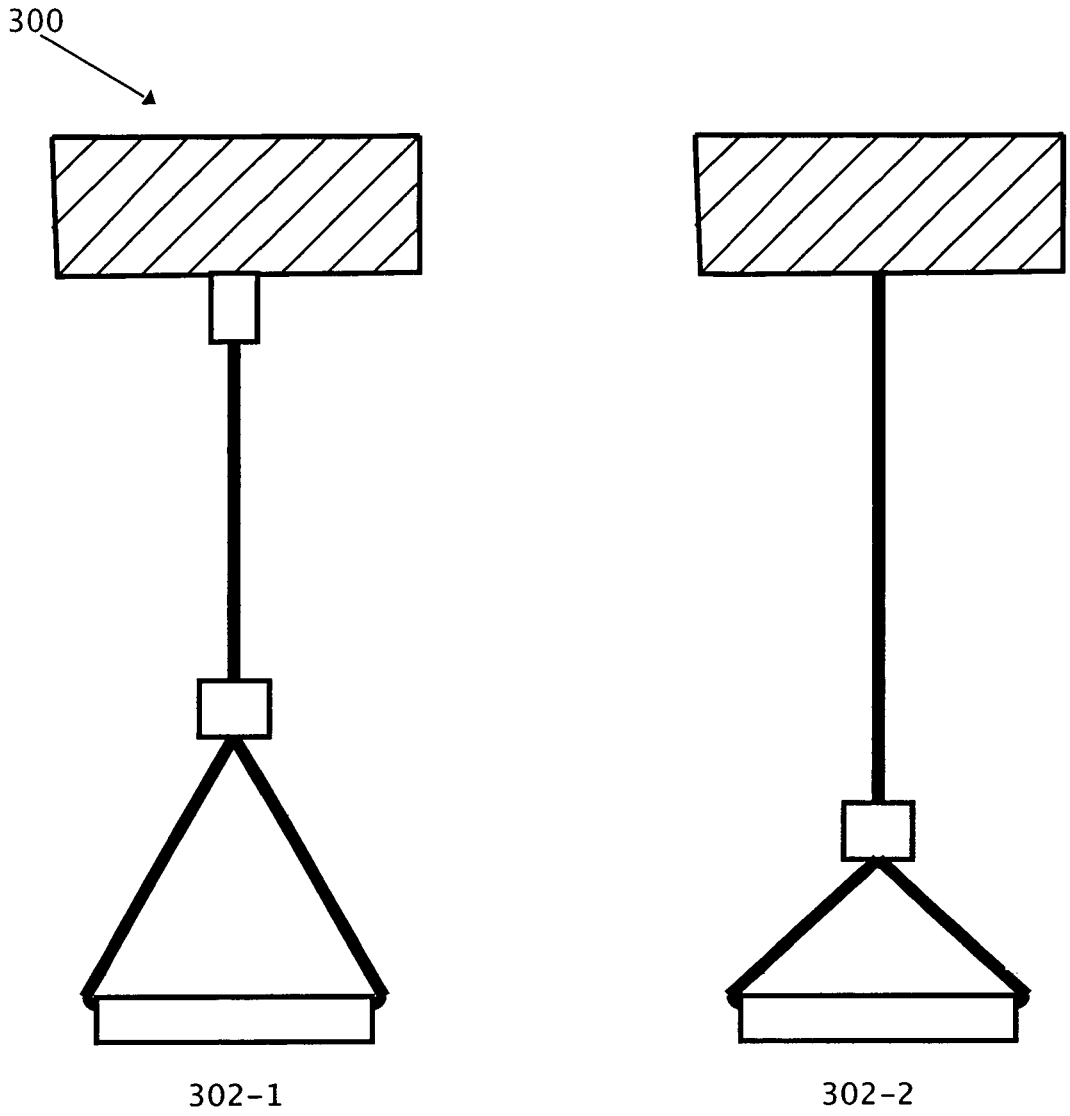
FIG. 3 depicts an example of an exercise device including a stability point set at two different positions.

FIG. 3 depicts an example of an exercise device 300 in positions of differing stability. Position 301-1 shows the control buckle closer to the handle. As such, the handle is less stable and stability muscles can be exercised. Positions 301-2 shows the control buckle farther from the handle. As such, the handle is more stable and target muscles can be exercised. These two positions are meant as illustrative only and many other possible positions are possible with the device 300. In addition, other techniques for controlling stability are possible including, but not limited to, introducing a spring element, varying the material of the control straps, and/or varying the width of a handle element.

Figure 4:
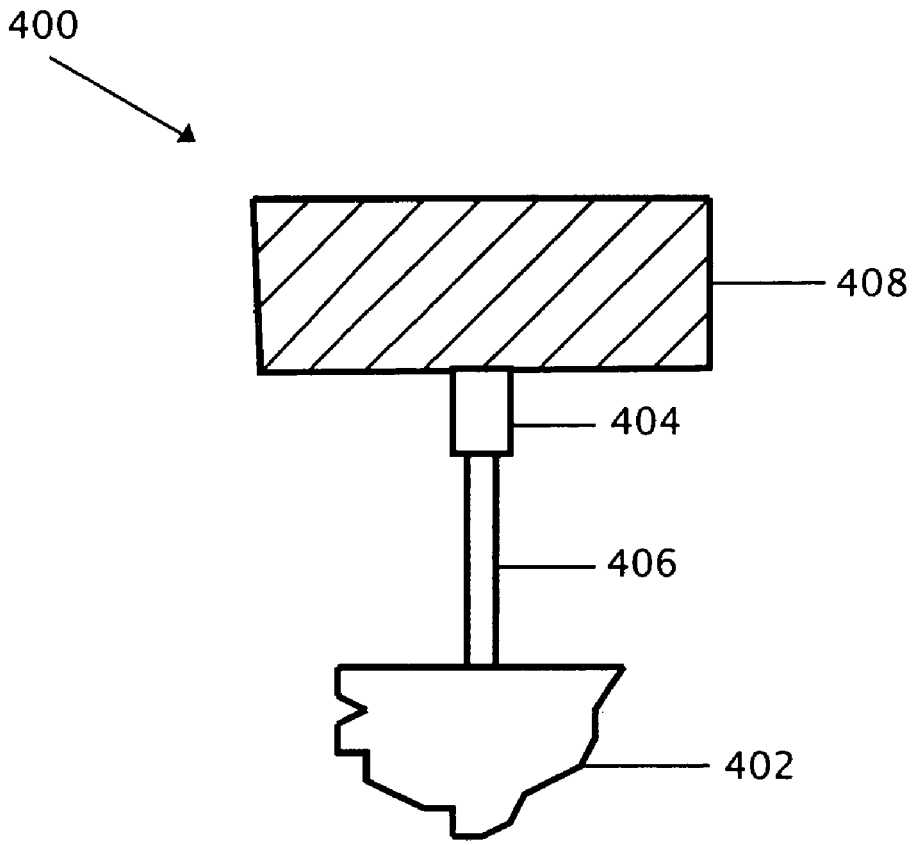
FIG. 4 depicts example embodiment of an exercise device with a handle with an irregular form factor.
Figure 5A:
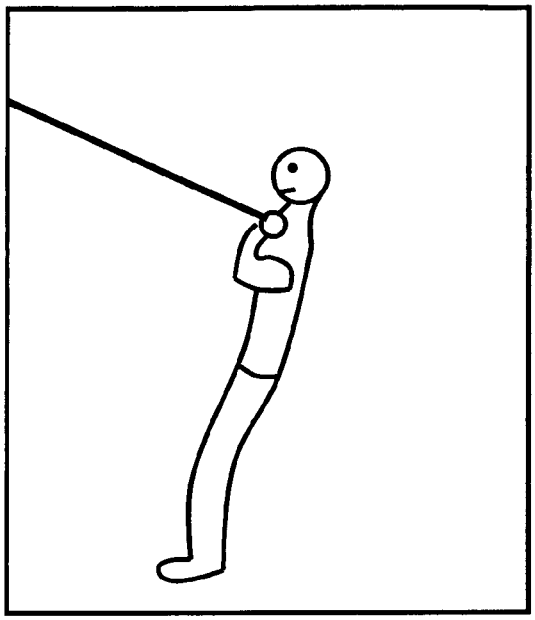
FIGS. 5A, 5B, 5C, & 5D depict examples of strength training and PNF exercises using an embodiment of the invention.
Figure 5A:
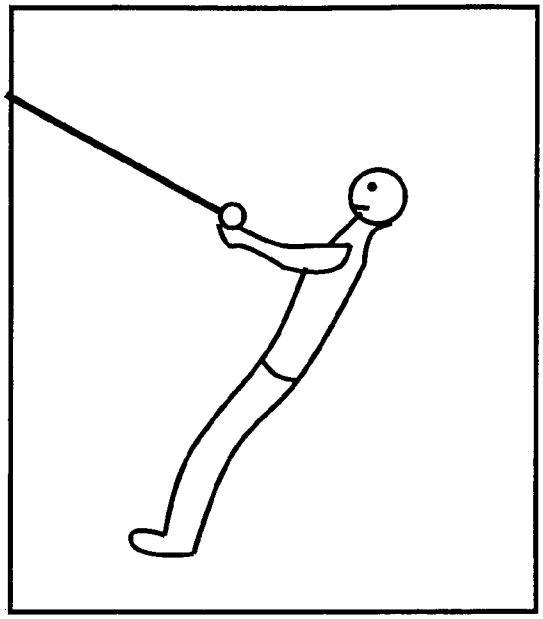
Figure 5A:
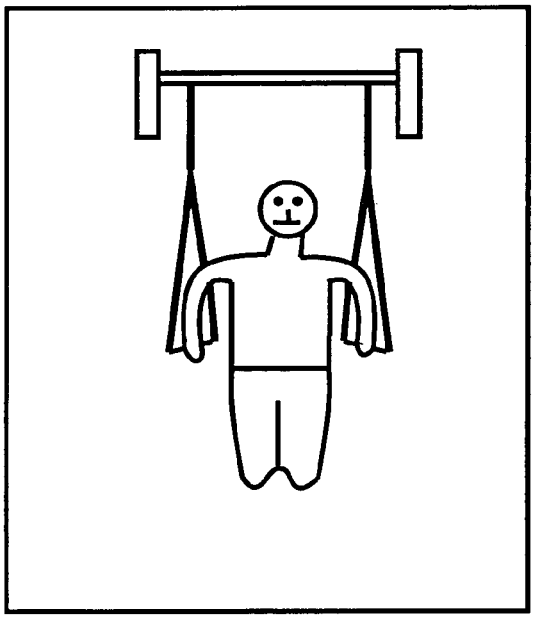
Figure 5A:
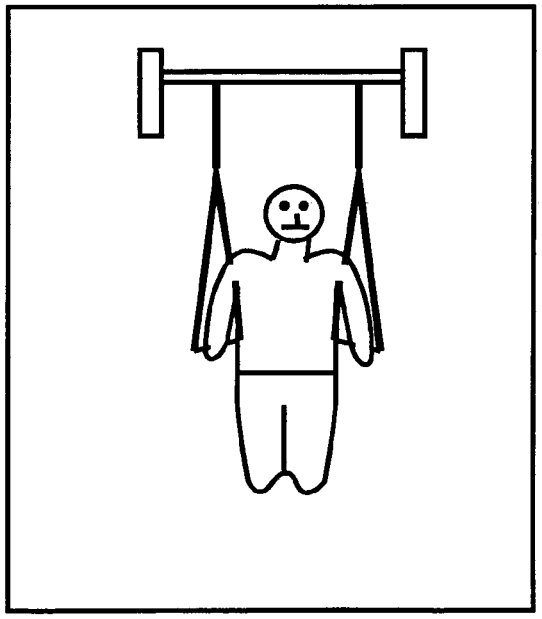
Figure 5B:
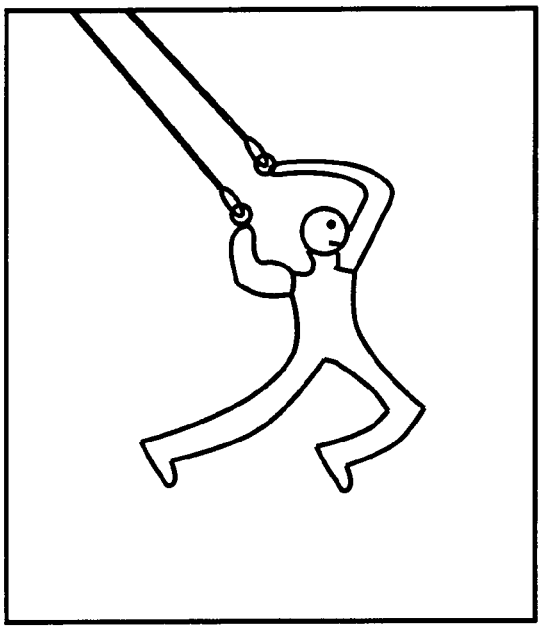
Figure 5B:
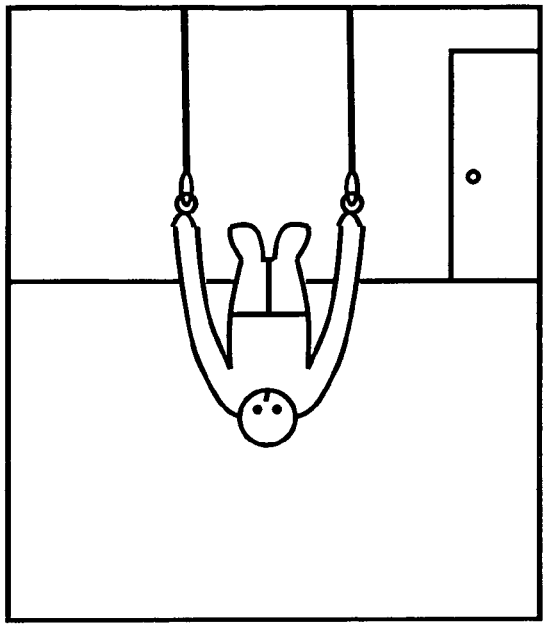
Figure 5B:
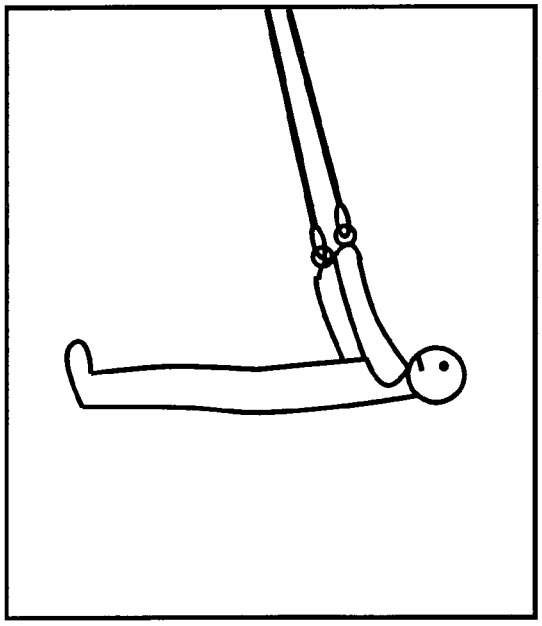
Figure 5B:
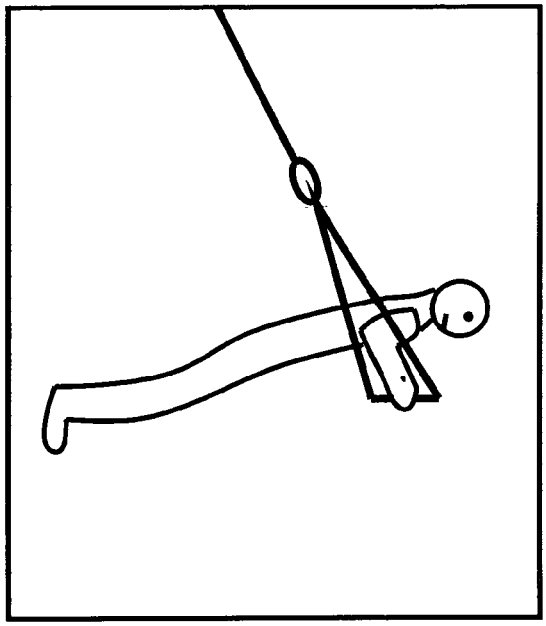
Figure 5C:
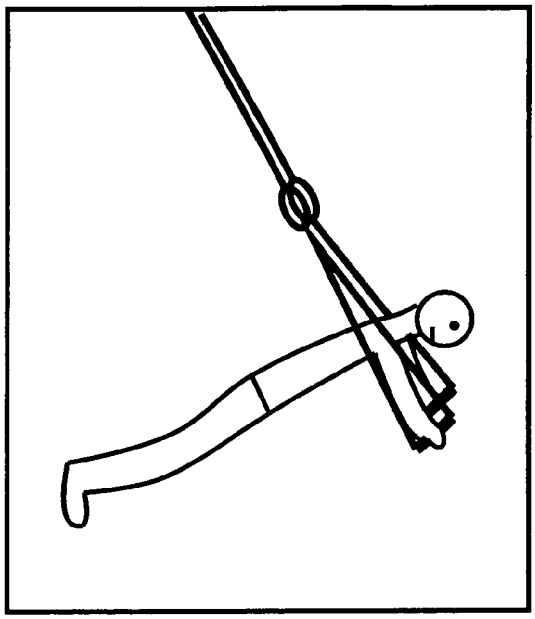
Figure 5C:
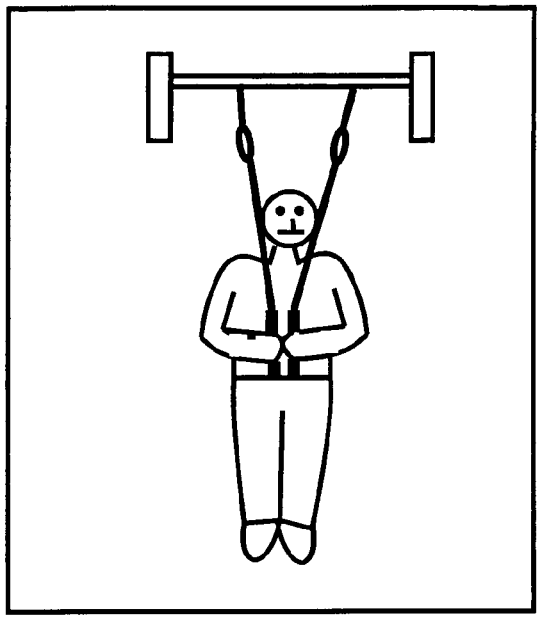
Figure 5C:
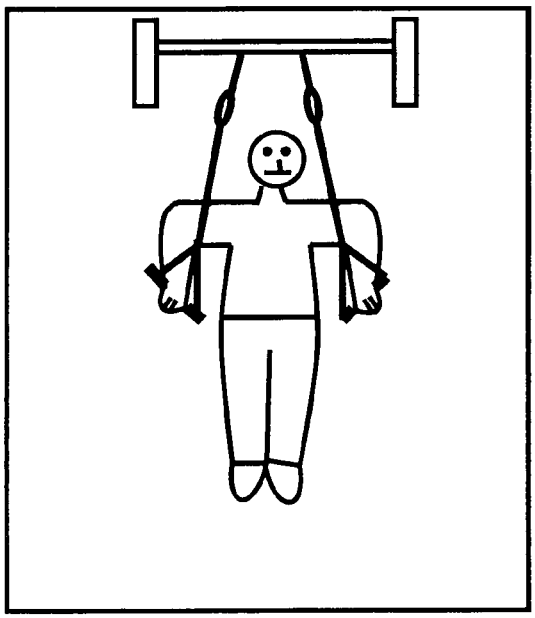
Figure 5C:
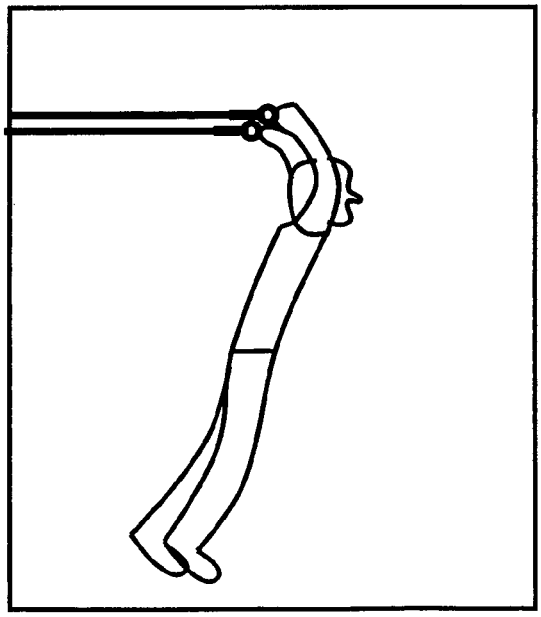
Figure 5D:
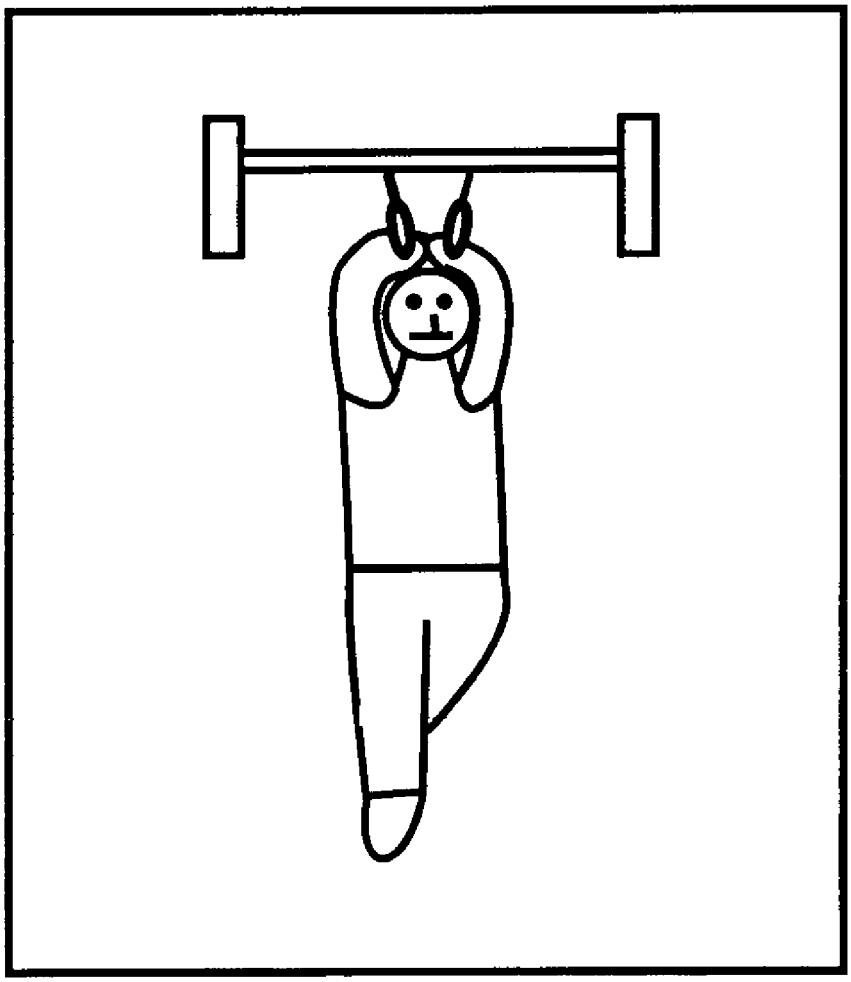

FIG. 4 depicts an alternate example of an exercise device 400. The exercise device 400 includes a handgrip 402, an anchor 404, a strap 406, and a support structure 408. In the example of FIG. 4, the handgrip 402 is resembles a rock including a rock that is used on a rock climbing wall. In one embodiment, the handgrip 402 is half of a rock with a fastening mechanism (not shown) for connecting to the strap 406. In other embodiments, the handgrip 402 is a full rock with a fastening mechanism protruding from a portion of the rock. In additional embodiments, the rock can be any known and/or convenient size and/or shape suitable for rock climbing strengthening exercises. In certain embodiments, the surface of the grip may be smooth, coarse, or any other surface texture known and/or convenient to use. Additionally, the handle may be plastic, metal, rubber, natural rock material, or another material known and/or convenient as a climbing wall grip. In some example embodiments, the handgrip can be exchanged to allow other handle shapes to be used.

FIGS. 5A, 5B, 5C, & 5D depict examples of strength training and PNF exercises using an embodiment of the invention. These examples are meant to be illustrative only and many other exercises are possible. In each exercise depicted other embodiments of the invention can be used in addition to the depicted embodiment.

Illustration 501-1 and illustration 501-2 depict two positions in a curl exercise, an exercise targeting the bicep muscle group. The body is alternatively lowered and raised between a contracted and extended position. The handles are gripped in an underhand manner and feet place in front of the center of gravity of the body. Illustration 501-1 depicts the contracted position where the body weight has been pulled toward the handles. Illustration 501-2 depicts the extended position. In this exercise the position of the feet may be varied to change the relative amount of body weight on the biceps or stabilizer muscles. The stability member position may also be varied relative to the handle to increase or decrease stability. The exercise depicted in illustration 502 could also show a PNF stretching exercise targeting the bicep muscle group.

Illustration 502-2 and illustration 502-2 depict two positions in a dip exercise, and exercise targeting the triceps and chest muscle groups. The body is alternatively lowered and raised between a contracted and extended position. The handles are gripped on top of the handles. The legs are then raised off the ground. Illustration 502-1 depicts the contracted position where the bodyweight has been lowered. Illustration 502-2 depicts the extended position where the body weight has been raised. The stability member position may also be varied relative to the handle to increase or decrease stability.

Illustration 503 depicts a stretching exercise targeting the back muscles. Illustration 503 depicts the extended position where the body weight is pulled away from the handles. In this stretching exercise both gravity and the user's leg muscles may be used as a force to stretch the target muscles. In some example embodiments, the stability member position may also be varied relative to the handle to increase or decrease stability.

Illustration 504-1 and illustration 504-2 depict two views of a stretching exercise targeting the back muscles. The user's feet are placed on a surface in front of them, and the body is held substantially parallel to the floor. Illustration 504-1 depicts a view from behind of the extended position where the body weight is pulled away from the handles by gravity. Illustration 504-2 depicts a side view of the exercise. In some example embodiments, the stability member position may also be varied relative to the handle to increase or decrease stability.

Illustration 505-1 and illustration 505-2 depict two positions in a chest press exercise, an exercise targeting the pectoral muscle group. The body is alternatively lowered and raised between a contracted and extended position. The handles are gripped in an overhand manner and feet place in behind the center of gravity of the body. Illustration 505-1 depicts the contracted position where the body weight has been lowered toward the handles. Illustration 505-2 depicts the extended position. In this exercise the position of the feet may be varied to change the relative amount of body weight on the pectorals or stabilizer muscles. The stability member position may also be varied relative to the handle to increase or decrease stability. The exercise depicted in illustration 505 could also show a PNF stretching exercise targeting the pectoral muscle group.

Illustration 506-1 and Illustration 506-2 depict two positions in a chest press exercise where the body is inclined, an exercise targeting the lower pectoral muscle group. The body is alternatively lowered and raised between a contracted and extended position. The handles are gripped in an overhand manner and feet place in behind the center of gravity of the body. Illustration 506-1 depicts the contracted position where the body weight has been lowered toward the handles. Illustration 506-2 depicts the extended position. In this exercise the position of the feet may be varied to change the relative amount of body weight on the pectoral or stabilizer muscles. The stability member position may also be varied relative to the handle to increase or decrease stability. The exercise depicted in illustration 506 could also show a PNF stretching exercise targeting the pectoral muscle group.

Illustration 507-1 and illustration 507-2 depict two views of a stretching exercise targeting the triceps muscle group. The user's feet are placed on a behind surface. Illustration 507-1 depicts a side view of the stretch. Illustration 507-2 depicts a front view of the stretch. In some example embodiments, the stability member position may also be varied relative to the handle to increase or decrease stability. In some example embodiments, different rock-climbing handles may be used.

As used herein, "strength training" is defined to include any resistance training, including training to increase muscle total strength, endurance, or cardiovascular exercise. As used herein, the term "embodiment" means an embodiment that serves to illustrate by way of example but not limitation. As used herein, rock handgrips refers to handles which resemble rocks including natural rocks and artificial rocks commonly encountered in rock-climbing that can be affixed to a rock-climbing wall.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. An exercise device comprising:

a hollow, rigid handle structure configured to receive a strap through its length, the strap exiting at opposite ends of the handle structure;

an elongated anchor strap having one end coupled to a connector and the other end coupled to a support point;

an elongated control strap threaded through the handle structure and coupled between the handle structure and the connector;

an adjustable stabilizing member slideably coupled with the elongated control strap between the handle structure and the connector, the adjustable stabilizing member causing a point of convergence of the elongated control strap and configured to traverse along the length of the control strap so that the point of convergence is closer to, or farther from, the handle structure, wherein the adjustable stabilizing member varies stability experienced by a user of the exercise device, wherein stability is increased the further the adjustable stabilizing member is located from the handle structure and stability is decreased the closer the adjustable stabilizing member is located to the handle structure;

an adjuster clamp coupled between the support point and the elongated anchor strap.

2. An exercise device as recited in claim 1, wherein the handle is at least 5 inches in length.

3. An exercise device as recited in claim 1, wherein the handle is supported by the elongated control strap.

4. An exercise device as recited in claim 1, wherein the adjustable stabilizing member includes a control buckle traversing the elongated control strap, thereby causing the point of convergence.

5. An exercise device as recited in claim 1 further comprising a padded strap attached to the ends of the handle, wherein, in operation, the padded strap is used as a contact point.

6. An exercise device as recited in claim 5, wherein, the padded strap is used as a contact point for the legs or abdomen.

7. An exercise device as recited in claim 1, wherein the handle structure is padded.

8. An exercise device as recited in claim 1, wherein the length of the elongated anchor strap is varied using the adjuster clamp.

9. An exercise device as recited in claim 8, wherein the elongated anchor strap is marked at a plurality of lengths.

10. An exercise device as recited in claim 9, wherein the elongated anchor strap marked at the plurality of marks lengths is adjustable based on user preference.

* * * * *